US005218848A

United States Patent [19]

Takakura et al.

[11] Patent Number: 5,218,848

[45] Date of Patent: Jun. 15, 1993

[54] METHOD AND APPARATUS FOR CORRECTING A WIDTHWISE BEND IN AN END PORTION OF A HOT-ROLLED SHEET-SHAPED PRODUCT

[75] Inventors: Yoshio Takakura; Tomoaki Kimura; Toshiyuki Kajiwara, all of Hitachi; Teruo Sekiya, Takahagi, all of Japan

[73] Assignee: Hitachi, Ltd., Tokyo, Japan

[21] Appl. No.: 883,246

[22] Filed: May 7, 1992

Related U.S. Application Data

[63] Continuation of Ser. No. 654,005, Feb. 12, 1991, abandoned.

[30] Foreign Application Priority Data

Feb. 13, 1990 [JP] Japan ..... 2-31794

[51] Int. Cl.[5] ..... B21D 1/02; B21B 39/12

[52] U.S. Cl. ..... 72/15; 72/161; 72/199; 72/250

[58] Field of Search ..... 72/199, 250, 206, 166, 72/160, 161, 14, 15, 12

[56] References Cited

U.S. PATENT DOCUMENTS 1,932,504 10/1933 Biggert ..... 72/407
3,425,249 2/1969 O'Brien ..... 72/12

FOREIGN PATENT DOCUMENTS 1045954 12/1958 Fed. Rep. of Germany ..... 72/250
3240692 5/1984 Fed. Rep. of Germany ..... 72/250
110408 6/1984 Japan ..... 72/250
215202 12/1984 Japan ..... 72/199

OTHER PUBLICATIONS

Japanese-language Iron & Steel Handbook (front paper; contents; p. 416; back paper).

*Primary Examiner*—Daniel C. Crane
*Attorney, Agent, or Firm*—Evenson, McKeown, Edwards & Lenahan

[57] ABSTRACT

A widthwise bend of an end of a hot-rolled elongate sheet-shaped metal product is corrected while it is hot. The correction comprises simultaneously:

(i) holding the edges of the product at at least two positions longitudinally spaced along the product thereby to hold, at least laterally, a portion spaced from the bent end, and (ii) pushing the end portion laterally by means of a laterally moving member. The method may be performed while the product is continuously moving along a path. Both steps (i) and (ii) are performed by rollers rotatable about vertical axes.

37 Claims, 6 Drawing Sheets

METHOD AND APPARATUS FOR CORRECTING A WIDTHWISE BEND IN AN END PORTION OF A HOT-ROLLED SHEET-SHAPED PRODUCT

This is a continuation of application Ser. No. 07/654,005, filed Feb. 12, 1991, now abandoned.

BACKGROUND OF THE INVENTION

1. Field of the invention

This invention relates to a method and apparatus for correcting a widthwise bend in an end portion of a hot-rolled elongate sheet-shaped metal product, the correction being performed while the product is still hot from the hot-rolling or after reheating of the product. The invention further relates to a hot strip mill including straightening apparatus for correcting such a bend. The invention is particularly applicable to hot-rolled products of steel and aluminium. The products may be intermediate products or final products.

2. Description of the Prior Art

In the hot-rolling of steel or aluminium products, typically a hot ingot is first passed several times through a roughing mill which forms it into a so-called bar, which is an elongate sheet-shaped product. Typically this bar has a width of 900 to 1500 mm, a thickness of 20 to 80 mm and a length of for example, 50 m. This bar, when intended for further rolling into a strip, is fed into a finishing mill comprising a number of roll sets and is coiled as a strip having a thickness of, for example, 2 to 6 mm, while still hot. Alternatively, the product from the roughing mill may take the finished form of a so-called sheet or plate.

All of these products from the roughing mill may suffer from the defect of a lateral bend in their head end portion or their tail end portion. The bend in the head end portion is usually larger, and causes greater difficulties, particularly if the product is a bar which is subjected to finishing rolling as described above. The bent head end causes problems during threading into the finishing train, which can lead to non-uniform thickness of the rolling in the finishing train and also a problem of folding of the leading end, as well as possible difficulties in coiling.

One solution to the problem is to cut off the bent portion, but since this may be 4 m long, it amounts to perhaps 8% of the product, which is wasteful.

One proposal in the prior art has been to correct the bend during the roughing rolling, using edger rollers which engage the edges of the bar during a rolling pass through the roughing mill. These edger rollers have vertical axes which are adjustable laterally of the bar and remain fixed during a rolling operation. A problem particularly caused here is that the edger roller presses with high force against the bar, causing thickening of the bar at that side, with consequent further problems during rolling.

An alternative possibility, not disclosed in the prior art, is to adjust the rollers of the roughing mill during a rolling pass, so that they roll the bar non-uniformly, in a manner which corrects the bend. This method however is thought to be not practical, on account of the high investment cost in designing the mill to perform this action.

In a hot-rolling mill, fixed side guides are disposed at several locations on the conveyor table for the hot-rolled bar, e.g. as illustrated in the Japanese-language Iron & Steel Handbook, page 416, for example. These side guides are fixed during rolling, but may effect some straightening of a bar having a widthwise bend simply by pressing upon the bar. However, the amount of straightening is small, because such guides are designed with a clearance between them and the edges of the bar. Typically this clearance is about 50 mm and is necessary because the edge of the strip is not straight. Accordingly, such a side guide cannot effect correction of a bend except perhaps over a very long length of the bar.

SUMMARY OF THE INVENTION

The object of the present invention is to provide a method and apparatus for correcting a bend in a hot-rolled product, in order to avoid at least partly the problems discussed above.

According to the invention in one aspect there is provided a method of correcting a widthwise bend of an end portion adjacent an end of a hot-rolled elongate sheet-shaped metal product while it is hot, comprising the steps of simultaneously:

(i) holding the two edges of the product at at least two positions longitudinally spaced along said product thereby to hold, at least laterally, a portion of said product spaced from said end, and (ii) pushing said end portion laterally by means of a laterally moving member so as at least partly to correct said bend.

The present invention is based on the realization that it is possible successfully to remove, at least partly, a widthwise bend in a hot-rolled product, while it is hot, by pushing the end portion laterally relative to an adjacent portion which is maintained along an axis so as to resist the pushing force. This can be done at a location spaced from any roll set. A laterally moving member is required to provide the lateral movement of the end portion. Fixed guides are not sufficient. In order to achieve the removal of the bend, at least partially, it is necessary to effect plastic deformation. It has now been found that this can be done without loss of planarity of the sheet-shaped product, i.e. buckling, and without deformation of the edge of the product by the forces applied to it. The material of the product must be sufficiently plastically deformable; practical limits are discussed below, and depend on at least temperature, thickness and width of the product.

In applying the appropriate forces to the hot-rolled product, various factors must be taken into consideration, depending on each case. Such factors are the temperature of the product, and width and thickness of the product. If it is too thin or too wide, there may be a risk of buckling or of deformation of the edges. Thus, the product should have the appropriate deformability, based on its Young's modulus and yield stress at the temperature in question.

While in principle the invention can be applied to a hot-rolled product which is temporarily held stationary for the bending operation to take place, this is not preferred, because the stopping of the hot product is liable to cause non-uniform cooling of parts thereof, leading to problems during subsequent rolling. Therefore, the invention is preferably performed upon a product which is moving continuously.

In the invention, the product is sufficiently held against lateral movement caused by the pushing force, this restraint occurring over a holding portion having a predetermined length adjacent the bend portion. It is sufficient to support the product at only the opposite ends of this holding portion, and at least for reasons of simplicity this is preferred in the invention. Alternatively, further supports may be provided between the ends of this holding portion.

Preferably, the distance $l_1$ between the pushing member which effects the correction of the bending and the nearer end of the holding portion is not larger than the length $l_2$ of the holding portion, and more preferably $l_2$ is not less than 1.5 $l_1$.

It is particularly preferred in the invention that the distance of lateral pushing effected by the pushing member is more than that required merely to straighten the bend, that is to say an excess or overpush is performed. When the end portion is released by retraction of the pushing member, it will spring back to a certain extent. If correctly calculated, this springback will bring the end portion back to the straight position, so that the bend is completely removed. Since, at least approximately, the amount of springback is independent of the plastic deformation which has taken place, the amount of the overpush required is independent of the amount of the initial bend. Thus, it is possible to control the pushing member so that, for each of a series of similar products which are subjected to straightening, it pushes the bent end portion to the same position, giving a predetermined amount of overpush, regardless of the initial pushing position. This predetermined amount of overpush is selected in accordance with the dimensions, temperature and nature of the material of the product.

To summarize this aspect therefore, the invention lies in a method of correcting a widthwise bend of an end portion of a hot-rolled elongate sheet-shaped metal product while it is hot, comprising applying a lateral pushing force to said end portion by means of a laterally moving member so as at least partly to eliminate the bend while holding a longitudinally extending portion of the product adjacent the end portion at both edges so as to resist the pushing force. Preferably the pushing force is sufficient to cause non-elastic deformation, while maintaining planarity of said product and substantially avoiding deformation of the edges of said product.

In a second aspect, the invention provides an apparatus for correcting a widthwise bend of an end portion of a hot-rolled elongate sheet-shaped metal product while the product is hot, comprising, (a) an elongate zone to receive said product, (b) means for engaging the edges of said product at at least two positions longitudinally spaced along said zone, so as to hold said product at least laterally, (c) pushing means including at least one pushing member spaced longitudinally along said zone from said engaging means and drive means to cause said pushing member to push said end portion laterally.

Preferably the edge engaging means comprise longitudinally spaced pairs of opposed rollers and means for moving the rollers laterally into engagement with the edges of the product. The means for moving the rollers may comprise a pair of side frames positioned respectively at the two sides of the elongate zone and supporting the rollers so that the roller axes on each side of the elongate zone are in a common plane, the common planes being parallel. Means are provided for moving the side frames towards and away from the elongate zone while maintaining the common planes parallel. The pushing member of the pushing means may be mounted on one of the side frames.

Suitably, the apparatus has a pair of the pushing members, mounted on opposite sides of the elongate zone, the drive means being arranged to cause the pushing member to push the bent end portion laterally from one of the opposite sides, in dependence on the direction of the bend.

In one embodiment, the edge engaging means has, at a first one of the two longitudinally spaced positions which is closer to the pushing member, roller means for contacting an edge of said product, said roller means comprising a plurality of rollers rotatable about vertical axes which, as seen in plan view, lie on a curve, so that the spacing of the axes from the elongate zone increases with decrease of the distance of the axes from the pushing member.

Preferably the two longitudinally spaced positions at which the edge engaging means engage said edges of said product are spaced apart longitudinally by a distance greater than the longitudinal distance along said zone between the pushing member and the closer of the two longitudinally spaced positions thereto.

The present invention is particularly useful when applied in a hot strip mill.

In another aspect the invention provides a hot strip mill comprising, (a) a roughing mill;

(b) a finishing mill;

(c) conveying means for conveying elongate roughed bar product from said roughing mill to said finishing mill, and (d) a straightener for correcting an end bend of said roughed bar product while on said conveying means, the straightener comprising at least one laterally movable member for pushing sideways on the bent end while lateral movement of a portion of the bar adjacent the bent end is restrained.

To give some non-limitative examples of dimensions and other factors which typically arise in present hot strip mill practice, and to which the invention is particularly applicable, the length of the bent end portion at the leading end of a so-called bar product emerging from the roughing mill is about 4 m. Thus, the distance $l_1$ mentioned above is preferably in the range of 3.5 to 5.5 m, and the length $l_2$ mentioned above is correspondingly at least equal to this distance or larger. The thickness of such a product is typically in the range of 20 to 80 mm and its width in the range of 900 to 1500 mm, although narrower products, e.g. down to 600 mm or wider products, e.g. up to 2 m, may also be suitable in the invention. More particularly, when the width is in the range of 900 to 1200 mm, the thickness is preferably in the range of 20 to 40 mm, in order for the invention to apply satisfactorily, and when the width is in the range of 900 to 1500 mm, the thickness may be in the range of 40 to 80 mm.

In the case of steel, the products in question are normally mild steel, silicon steel or stainless steel, and the temperature of the product during the straightening operation in a hot strip mill is generally over 700° C., preferably at least 900° C. Such a product is typically moving at a speed of about 2 m/s on the roller table, so that the pushing means must operate in preferably a time of 1 s or even less.

For aluminium, the relevant temperature is lower, for example in the range of 400° to 500° C.

Although the invention is in principle applicable to both the head end and the tail end, it is more effective when applied to the head end.

BRIEF DESCRIPTION OF THE DRAWINGS

Embodiments of the inventions will now be described by way of non-limitative example with reference to the accompanying drawings, in which.

DESCRIPTION OF THE PREFERRED EMBODIMENTS

Figure 1:
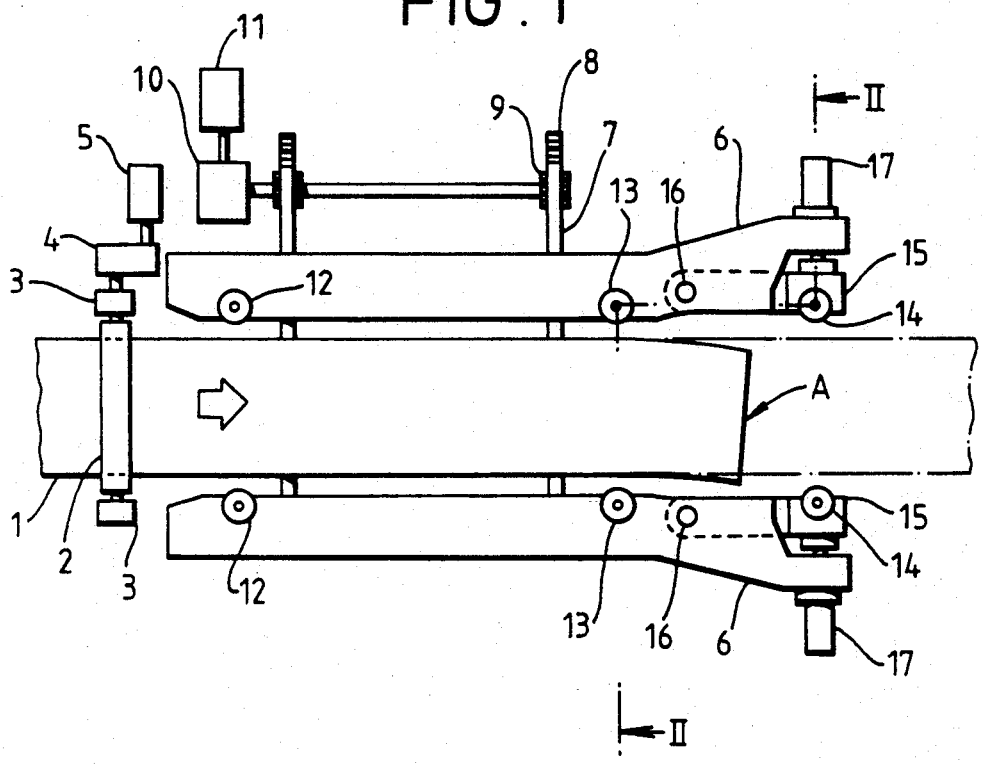
FIG. 1 is a top plan view showing apparatus for correcting the bend of the leading end of a hot-rolled sheet according to one embodiment of the present invention.
Figure 2:
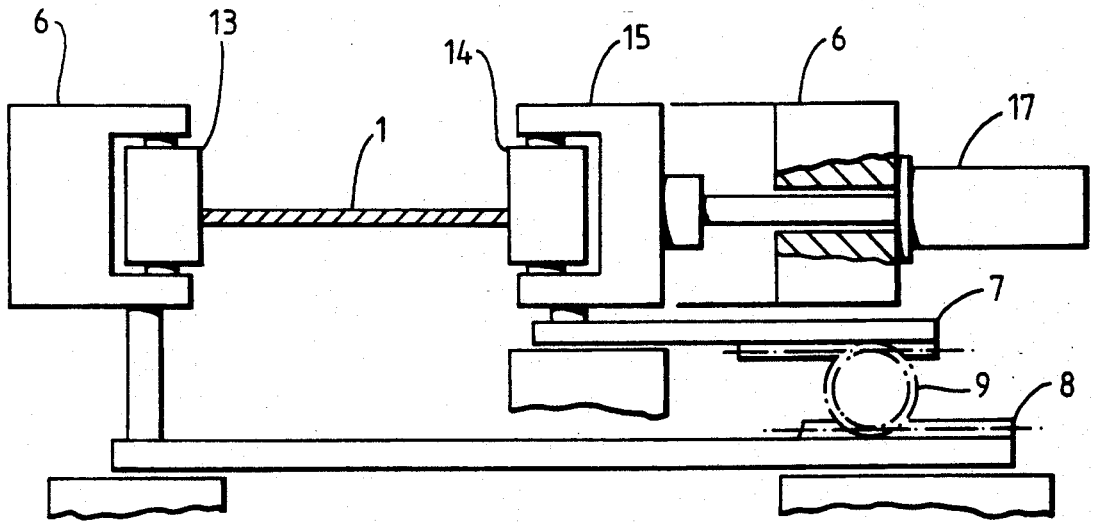
FIG. 2 is a section taken along lines II—II of FIG. 1.
Figure 3A:
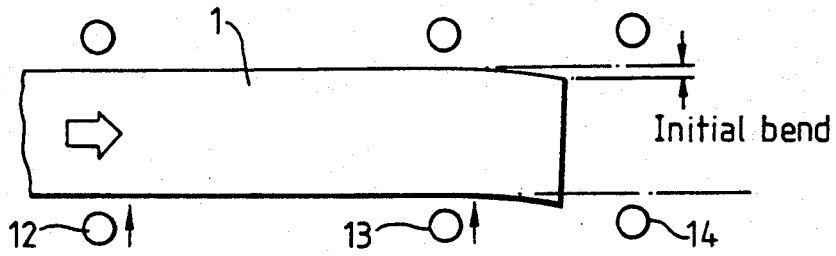
FIGS. 3(*a*) to 3(*d*) are diagrams explaining the process for correcting the bend of the leading end.
Figure 3B:
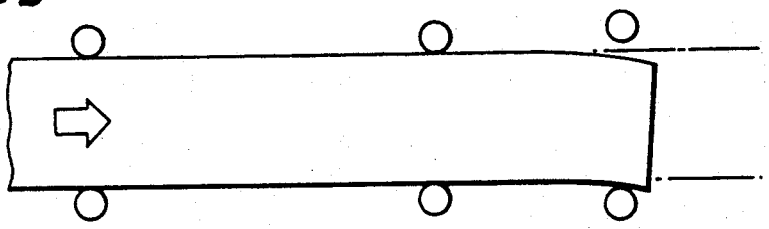
Figure 3C:
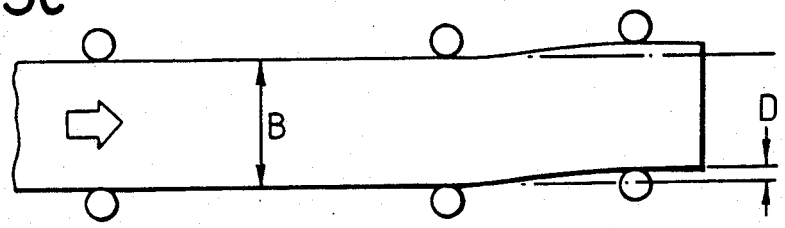
Figure 3D:
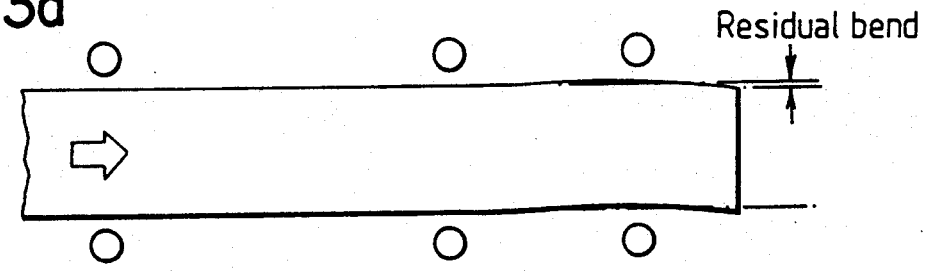

With reference to FIGS. 1 to 4, the correcting apparatus of the present embodiment is equipped with a pinch roller 2 for feeding forward a hot-rolled sheet 1 having a bend A at its leading end. This pinch roller 2 is driven by a drive motor 5 through a bearing 3 and a reduction gear mechanism 4. Downstream of the pinch roller 2, there are arranged at the two sides of the path of the hot-rolled sheet 1 a pair of side guide frames 6, which are driven to open or close by a drive motor 11 through racks 7 and 8, pinions 9 and a reduction gear machanism 10, as also shown in FIG. 2. At two longitudinally spaced portions of the side guide frames 6, there are attached two pairs of opposed vertical rollers, i.e. first rollers 12 and second rollers 13, which are moved away from or towards each other by opening or closing the side guide frames 6. Downstream of these first and second rollers 12 and 13, there are arranged another opposed pair of vertical pushing rollers, i.e. third rollers 14. These rollers 14 are attached to movable frames 15, which in turn are hinged by means of vertical pins 16 to the front end portions of the side guide frames 6. When the movable frames 14 are driven by means of cylinders 17, the third rollers 14 are pushed widthwise of the hot-rolled sheet 1.

In operation of the structure thus far described, when and after the leading end of the hot-rolled sheet 1, which is still in hot condition, passes the first and second rollers 12 and 13, the hot-rolled sheet 1 has its leading end given a sufficient counter bend and corrected by holding the hot-rolled sheet 1 centrally of its path line by means of the first and second rollers 12 and 13 and by pushing the third rollers 14 widthwise. At this time, the feeding force necessary for moving the bar during correcting of the bend of the leading end is given the pinch roller 2.

The process for correcting the bend of the leading end will be described in more detail with reference to FIG. 3.

The first, second and third rollers 12, 13, and 14 are held on standby while in the open state, as shown at (a) in FIG. 3, until the leading end of the hot-rolled sheet 1 having the bend A passes the second rollers 13. When the leading end comes near to the position of the third rollers 14, the first and second rollers 12 and 13 are moved widthwise, as shown at (b) in FIG. 3, to hold or restrain the hot-rolled sheet 1 centrally of the path line. At this time, the third rollers 14 are not yet in contact with the sides of the hot-rolled sheet 1.

As the leading end of the hot-rolled sheet 1 passes the third rollers 14, one of these rollers 14 gradually starts to push. This lateral push of the third rollers 14 is performed by forcing widthwise the roller 14 located in the bend direction of the leading end, i.e., the lower roller in the case as shown. The remaining opposite or upper roller, as shown is either caused to follow the lower one or held in its open position. Moreover, the push of the third roller 14 is performed to a position over the sheet width beyond the position corresponding to the straight sheet, i.e. 14 there is an over-push. This is because a relatively large bend is left after the push unless the push is excessive, since the hot-rolled sheet is elastic and springs back when released.

Figure 4A:
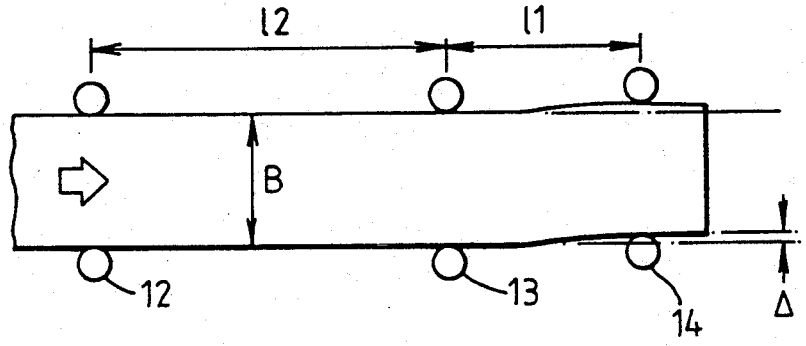
FIG. 4 is a diagram plotting the experimental results for the depth of push.
Figure 4B:
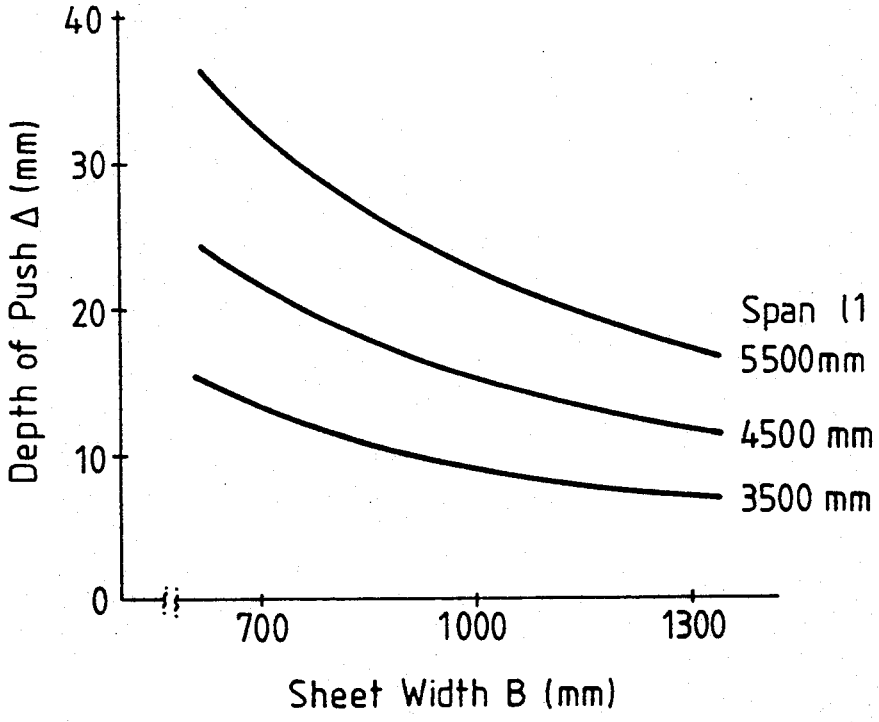

FIG. 4 plots the experimental results concerning the relation of necessary depths of over-push Δ (equal to the amount of the spring back) to the width B of the hot-rolled sheet 1 for different values of the parameter of span $l_1$ between the second and third rollers 13 and 14 and for material of Young's modulus $1.2\times10^4$ kg/mm$^2$ and yield stress of 6 kg/mm$^2$. It is understood from the graph that the necessary depth of push Δ becomes more for the smaller sheet width B and for the longer span $l_1$.

Thus, by performing the over-push estimating the extent of the springback after release, the residual bend is reduced to one quarter or less of the initial bend of the leading end. The bend of the leading end of the hot-rolled sheet 1 is usually 30 to 40 mm or less. In this case the residual bend after the correction is 10 mm or less. A residual bend of this order will raise no substantial problem in the passage through the subsequent finish rolling machine (or the reduction due to an unbalanced push), in the offset of the take-up machine (coiler), and in the production yield.

After the push is complete, the first to third rolls 12, 13 and 14 are rapidly opened, as shown at (d) in FIG. 3, to end the correction.

According to the present embodiment, therefore, the bend of the leading end of the hot-rolled sheet can be positively corrected to improve the passage through the finish rolling machine thereby to prevent reduction and offset at the take-up machine and to improve the production yield.

Since, moreover, the push of the hot-rolled sheet is accomplished by means of the rollers 12, 13 and 14, the correction of the bend of the leading end can be accomplished while the hot-rolled sheet is being continuously fed. With this correction during the movement of the hot-rolled sheet 1, it is possible to prevent the temperature of the hot-rolled sheet 1 from dropping and the sheet from being cooled down at the feed rollers.

In order to effect the correction during the movement of the hot-rolled sheet 1, the first to third rollers 12, 13 and 14 have to be opened or closed at high speeds. Preferably the actual pushing is accomplished in 1 s or less. On the other hand, the first and second rollers 12 and 13 and the third rollers 14 have to be operated at predetermined timings. These timings can be realized, for example, by arranging a sensor upstream of the pinch roller 2 to detect the passage of the leading end of the hot-rolled sheet, and by driving the motor 11 and by driving the cylinders 16 at predetermined times after detection.

The bend of the leading end of the hot-rolled sheet 1 is usually 30 to 40 mm or less and is frequently located at a distance of about 5 m from the leading end. Hence, the distance between the second rollers 13 and the third rollers 14 is desirably 5 m or less, e.g. about 4 m.

It will be appreciated that the direction of pushing of the bent end depends upon the direction of the bend being corrected. Since, as explained above, the end position to which the pushing member pushes the bent end can be chosen independently of the initial amount of bend, the control of the apparatus in dependence upon the particular product can be limited to control of the direction of pushing. This can be done manually, following inspection of the next product to be treated. Alternatively, a sensor may be arranged to detect the direction of the bend and control the direction of pushing accordingly.

Figure 6:
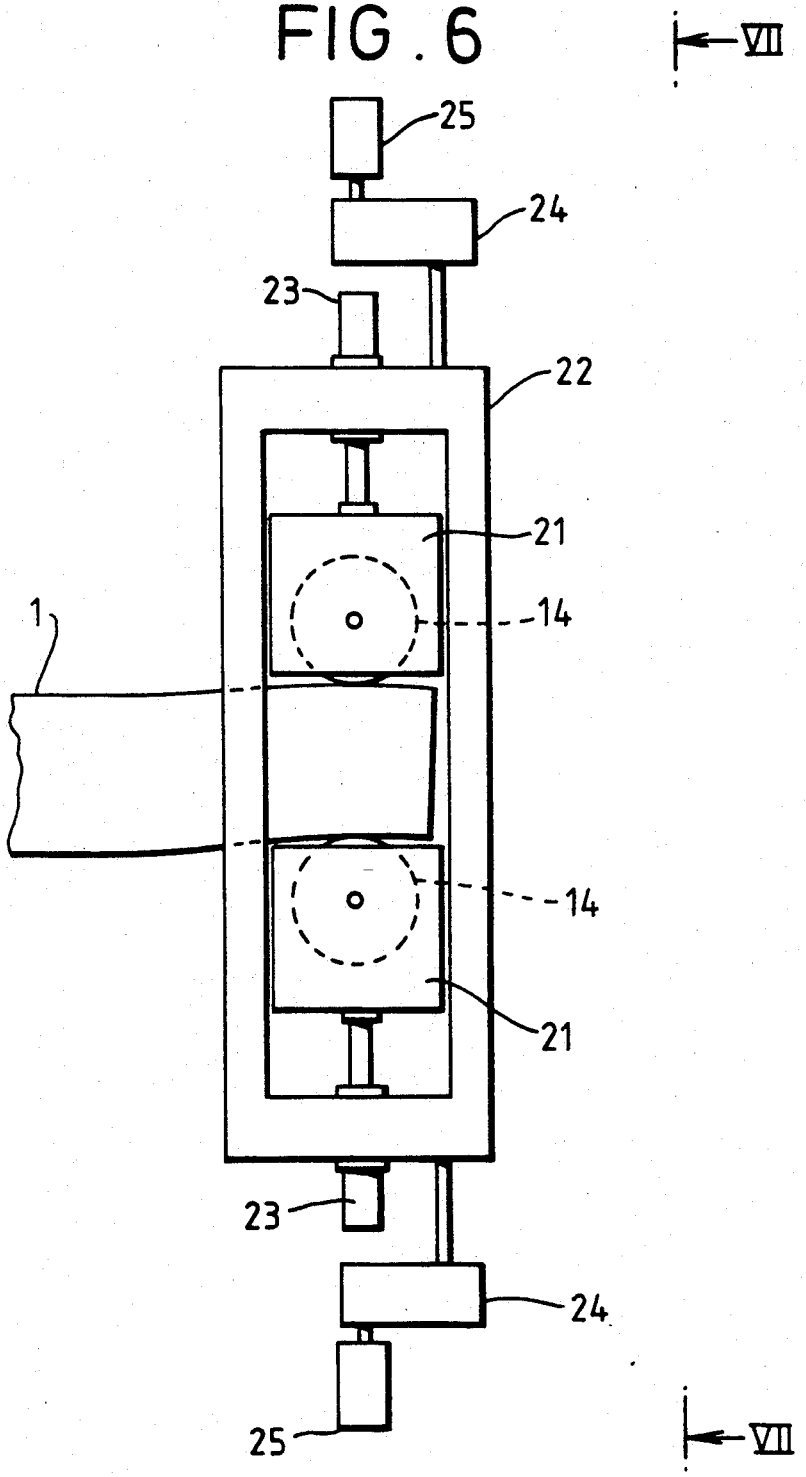
FIG. 6 is an enlarged plan view of part of FIG. 5 showing the portion including the pushing rolls.
Figure 7:
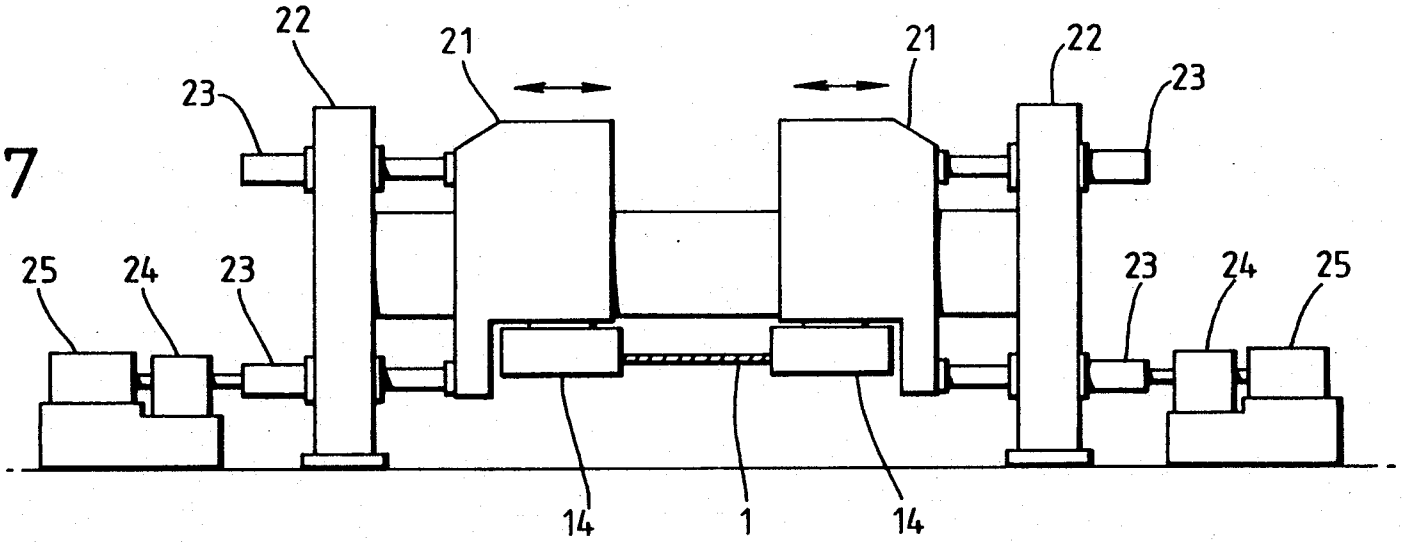
FIG. 7 is an end view taken along line VII—VII of FIG. 6.

Another embodiment of the present invention will be described with reference to FIGS. 5 to 7. Parts corresponding to those of FIG. 1 are not fully described again. In the present embodiment, the pushing third rollers 14 are separated from the side guide frames.

Figure 5:
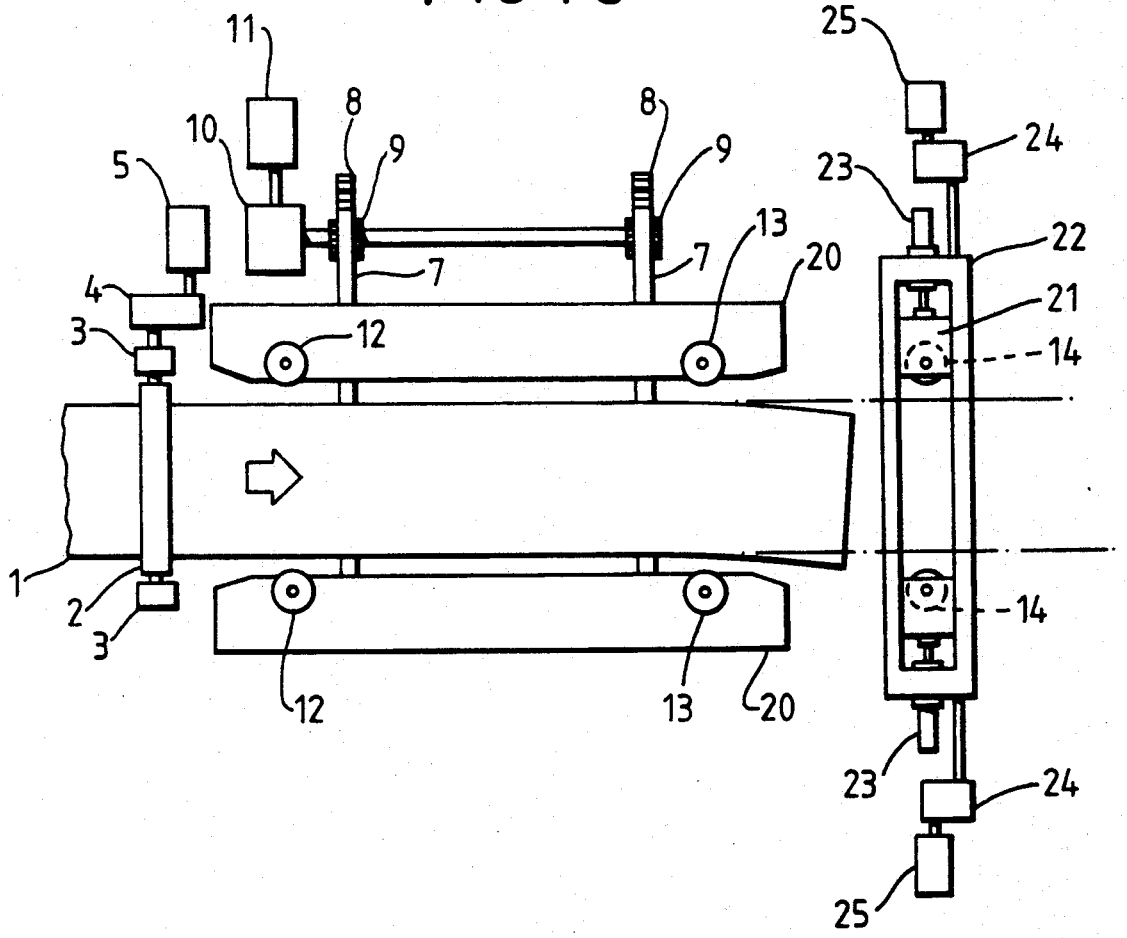
FIG. 5 is a top plan view showing bend correcting apparatus according to another embodiment of the present invention.

In FIG. 5, the side guide frames 20 are constructed to carry the first and second rollers 12 and 13 only and are opened or closed by means of the mechanism of the racks 7 and 8 and the pinions 9. On the other hand, the third rollers 14 are carried by chocks 21 which can be reciprocated in a stand 22. Thus, the third rollers 14 are opened or closed by driving push means 23, which are connected to the chocks 21, by means of motors 25 through gear mechanisms (not shown) which are built in the stand 22 and reduction gear mechanisms 24.

In the present embodiment, too, similar effects can be attained by correcting the bend of the leading end of the hot-rolled sheet 1 in the same way as with the foregoing embodiment.

Figure 8:
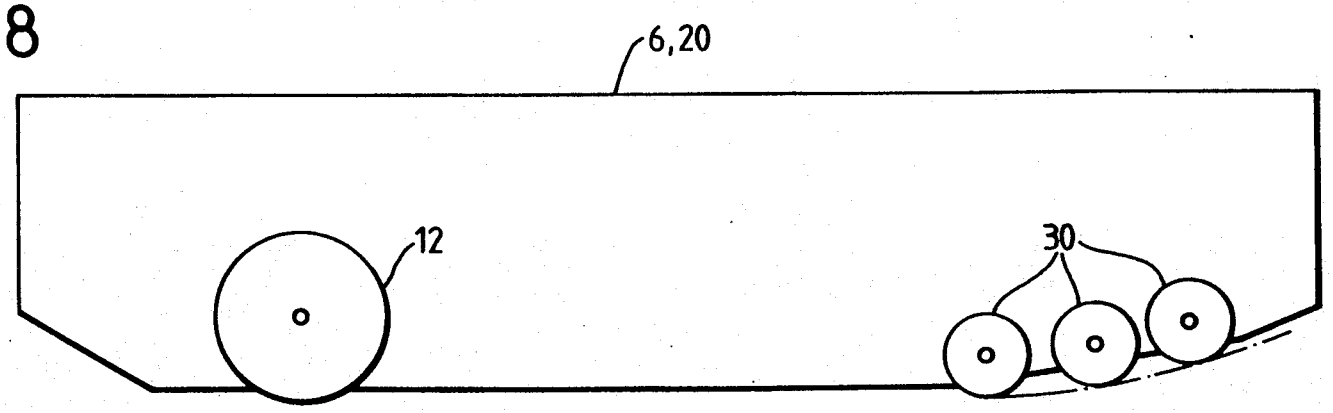
FIG. 8 is an enlarged diagrammatic view showing an element of correcting apparatus according to still another embodiment of the present invention.

Still another embodiment of the present invention will be described with reference to FIG. 8 which differs only at the second rollers. In this case, the second rollers are not constructed as a single pair of rollers but are each composed of a number of vertical small-diameter basket rollers 30 having a large virtual roller diameter. As FIG. 8 shows, the axes of these rollers 30 lie on a curve, so that they are increasingly spaced from the centre line of the path of the moving hot-rolled sheet in the downstream direction. This structure is made to avoid the local deformation of the hot-rolled sheet. Specifically, what is given most intense force for the correction in the foregoing embodiments is the second rollers 13. Depending upon the specification of the hot-rolled sheet, it is necessary to avoid any significant reduction in the width due to the local pushing by the second rollers 13. According to the present embodiment, however, the load can be dispersed by using the numerous basket rollers 30 having a large virtual roller diameter so that the tendency to width reduction can be decreased.

Figure 9:
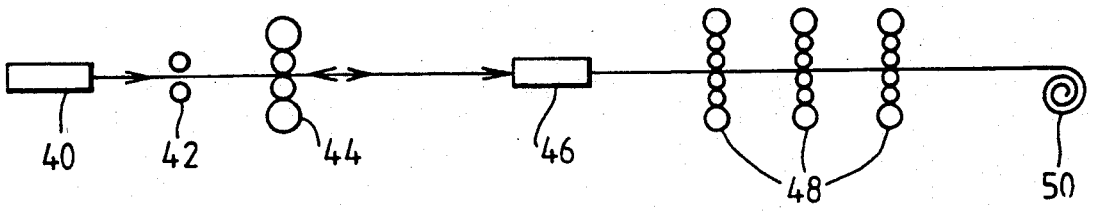
FIG. 9 is a diagrammatic view of a hot strip mill embodying the invention.

FIG. 9 shows diagrammatically a hot strip mill to which the invention is applied. A hot ingot 40, e.g. from a soaking furnace passes through a scale breaker 42 to a roughing mill 44 where it is rolled in many passes into a bar of sheet shape. Then it is straightened by straightening apparatus 46 of the invention as illustrated above before being rolled in a single pass through finishing train roll stands 48 and being coiled at coiler 50.

One non-limitative example of the method of the invention will now be given.

EXAMPLE

In straightening apparatus as shown in FIG. 1 a mild steel bar of dimensions 40 mm thick, 1000 mm wide and 60 m long at 1000° C. (Young's modulus $1.1\times10^4$ kg/mm$^2$, yield stress 6.0 kg/mm$^2$) is moved at 1.2 m/s. It had an initial bend of 40 mm at its leading end. The span $l_1$ (see FIG. 4) between second rollers 13 and the pushing rollers 14 is 4500 mm, and the span $l_2$ between the first and second rollers is 6750 mm. Straightening of the bend to a residual bend of less than 10 mm was achieved in the manner described above. The maximum bending force at the second roller 13 was 23000 kg.

What is claimed is:

1. A method of correcting a widthwise bend of an end portion adjacent an end of a sheet-shaped metal product while it is hot, comprising the steps of:

conveying rolled metal product away from a rolling mill along a conveying path, sensing the direction of the widthwise bend at the end portion of the product, holding edges of said product at at least two positions, downstream from the rolling mill, longitudinally spaced along said product thereby to hold, at least laterally, a portion of said product spaced from said end, and pushing said end portion laterally, opposite the direction of the widthwise bend, by means of a laterally moving member positioned separate from said two positions while said product is held at said two positions so as to at least partly to correct said bend.

2. A method according to claim 1 wherein said steps of holding and pushing are performed while said product is continuously moving along a path.

3. A method according to claim 2 wherein said steps of holding and pushing utilize are holding and pushing rollers rotatable about vertical axes and engageable with edges of said product.

4. A method according to claim 4 wherein said step of holding is performed utilizing at least two longitudinally spaced pairs of said holding rollers, each pair of said holding rollers comprising opposed holding rollers which respectively engage opposite edges of said product, said axes of said pairs of holding rollers lying respectively in two parallel planes on opposite sides of said product, and said holding rollers being moved into engagement with said edges of said product while said planes are maintained parallel.

5. A method according to claim 1 wherein said step of pushing comprises pushing said end portion laterally by an amount more than the amount of said bend, and permitting said bend portion to spring back after said pushing.

6. A method of correcting a widthwise bend of an end portion of an elongate sheet-shaped metal product having opposed, longitudinally extending edges while it is hot, comprising the steps of: conveying the product away from a rolling mill, sensing the direction of the widthwise bend at the end portion of the product, and applying a lateral pushing force to said end portion, opposite the direction of the widthwise bend, by means of a laterally moving member so as at least partly to eliminate said bend while holding a longitudinally extending portion of said product adjacent said end portion at both edges thereof so as to resist said pushing force, said holding including engaging said product at at least two positions longitudinally spaced from one another along said product.

7. A method according to claim 6 wherein said pushing force is sufficient to cause non-elastic deformation thereby at least partly to eliminate said bend, while maintaining planarity of said product and substantially avoiding deformation of the edges of said product.

8. Apparatus for correcting a widthwise bend of an end portion of a sheet-shaped metal product while said product is hot, comprising:

an elongated zone, away from a rolling mill, to receive said product from the rolling mill, edge holding means for engaging edges of said product at at least two positions longitudinally spaced along said elongate zone, so as to hold said product at least laterally, sensing means for sensing the direction of the widthwise bend, and pushing means separate from said edge holding means, including at least one pushing member, for contacting said end portion, spaced longitudinally along said elongate zone from said edge holding means, and drive means to cause said pushing member to push said end portion laterally in direction opposite to the direction of the widthwise bend while said edge holding means are positioned to contact edges of said product.

9. Apparatus according to claim 8 including means for moving said product longitudinally along said elongate means.

10. Apparatus according to claim 8 wherein said edge holding means comprise longitudinally spaced pairs of opposed holding rollers and means for moving said holding rollers laterally into engagement with said edges of said product.

11. Apparatus according to claim 10 wherein said means for moving said holding rollers comprises (a) a pair of frames positioned respectively at the two sides of said elongate zone, each said side frame supporting said holding rollers so that respective roller axes on each side of the elongate zone are in a common plane, the common planes being parallel, and (b) means for moving said side frames towards and away from said elongate zone while maintaining said common planes parallel.

12. Apparatus according to claim 11 wherein said at least one pushing member of said pushing means is mounted on said side frames.

13. Apparatus according to claim 8 having a pair of said pushing members, mounted on opposite sides of said elongate zone, said drive means being arranged to cause said pushing members to push said end portion of the product laterally from opposite sides, in dependence on the direction of the bend of the product.

14. Apparatus according to claim 8 wherein said engaging means has, at a first one of said two longitudinally spaced positions which is closer to said pushing member than the other of said two positions, roller means for contacting an edge of said product, said roller means comprising a plurality of rollers rotatable about vertical axes which, as seen in plan view, lie on a curve in a manner such that the spacing of said axes from said elongate zone increases with decrease of the distance of said axes from said pushing member.

15. An apparatus according to claim 8 wherein said two longitudinally spaced positions at which said engaging means engages said edges of said product are spaced apart longitudinally by a distance greater than the longitudinal distance along said zone between said pushing member and the closer of said two longitudinally spaced positions thereto.

16. A hot strip mill comprising, a roughing mill;

a finishing mill;

conveying means for conveying elongate roughened bar product from said roughing mill to said finishing mill, sensing means for sensing the direction of a widthwise bend in the elongate rough bar, and a straightener for correcting an end bend of said roughed bar product while on said conveying means, the straightener comprising at least one laterally movable element and a holding apparatus, said laterally movable element positioned for pushing sideways on the bent end in a direction opposite to the direction of the bend while lateral movement of a portion of the bar adjacent the bent end is restrained by said holding apparatus engageable with said bar product at at least two positions longitudinally spaced from one another along said product, said laterally movable element being separate from said holding apparatus.

17. A method for correcting a widthwise bend of an end portion of a rolled metal product as said product exits a rolling mill, comprising:

conveying the rolled metal product away from the rolling mill along a conveying path, holding a longitudinally extending portion of said product adjacent said end portion at at least two portions longitudinally spaced along said product while conveying the rolled metal product along its conveying path;

sensing the direction of the widthwise bend; and applying a lateral pushing force separate from said two positions to said end portion while holding said end portion at said two positions and while conveying the rolled metal product along its conveying path, the direction of said pushing force being opposite to the sensed direction of the bend.

18. A method according to claim 17, wherein said step of holding includes engaging both lateral edges of said rolled metal product along an elongate holding zone by means of holding members, and wherein said step of applying a lateral pushing force includes engaging said rolled metal product with pushing member means at a position spaced from the elongate holding zone by a distance which is smaller than the length of the elongate holding zone.

19. A method according to claim 18, wherein said holding members are respective holding roller members which are rotatable about holding roller axes extending perpendicular to the conveying path.

20. A method according to claim 18, wherein said pushing member means includes at least one pushing roller member rotatable about a pushing roller axis extending perpendicular to the conveying path.

21. A method according to claim 19, wherein said pushing member means includes at least one pushing roller member rotatable about a pushing roller axis extending perpendicular to the conveying path.

22. A method according to claim 17, wherein said step of applying a lateral pushing force includes laterally forcing said end portion sufficiently to plastically deform said end portion by a predetermined amount.

23. A method according to claim 21, wherein said step of applying a lateral pushing force includes laterally forcing said end portion sufficiently to plastically deform said end portion by a predetermined amount.

24. A method according to claim 21, wherein said holding roller members include a respective pair of inlet holding roller members at an inlet end of said elongate holding zone and a respective pair of outlet holding roller members at an outlet end of said elongate holding zone.

25. A method according to claim 21, wherein said holding roller members includes a respective pair of inlet holding roller members at an inlet end of said elongate holding zone and a plurality of outlet holding roller members curvilinearly disposed at an outlet end of said elongate holding zone.

26. Apparatus for correcting a widthwise bend of an end portion of a rolled metal product as said product exits a rolling mill, comprising:

conveying apparatus for conveying the rolled metal product away from the rolling mill along a conveying path, holding apparatus for holding a longitudinally extending portion of said product at at least two positions longitudinally spaced along said product adjacent said end portion while conveying the rolled metal product along its conveying path;

a sensor for sensing the direction of the widthwise bend; and lateral pushing apparatus means for applying a lateral pushing force separate from said holding apparatus to said end portion while holding said longitudinally extending portion at said two positions and while conveying the rolled metal product along its conveying path, the direction of said pushing force being opposite to the sensed direction of the bend.

27. Apparatus according to claim 26, wherein said holding means includes means for engaging both lateral edges of said rolled metal product along an elongate holding zone by means of holding members, and wherein said lateral pushing means includes means for engaging said rolled metal product with pushing member means at a position spaced from the elongate holding zone by a distance which is smaller than the length of the elongate holding zone.

28. Apparatus according to claim 27, wherein said holding members are respective holding roller members which are rotatable about holding roller axes extending perpendicular to the conveying path.

29. Apparatus according to claim 27, wherein said pushing member means includes at least one pushing roller member rotatable about a pushing roller axis extending perpendicular to the conveying path.

30. Apparatus according to claim 28, wherein said pushing member means includes at least one pushing roller member rotatable about a pushing roller axis extending perpendicular to the conveying path.

31. Apparatus according to claim 26, wherein said lateral pushing means includes means for laterally forcing said end portion sufficiently to plastically deform said end portion by a predetermined amount.

32. Apparatus according to claim 30, wherein said lateral pushing means includes means for laterally forcing said end portion sufficiently to plastically deform said end portion by a predetermined amount.

33. Apparatus according to claim 30, wherein said holding roller members include a respective pair of inlet holding roller members at an inlet end of said elongate holding zone and a respective pair of outlet holding roller members at an outlet end of said elongate holding zone.

34. Apparatus according to claim 30, wherein said holding roller members include a respective pair of inlet holding roller members at an inlet end of said elongate holding zone and a plurality of outlet holding roller members curvilinearly disposed at an outlet end of said elongate holding zone.

35. Apparatus according to claim 30, wherein said holder roller members are disposed on respective laterally movable holding frame members.

36. Apparatus according to claim 35, wherein said at least one pushing roller member is carried by said holding frame members by bearing support means which are movable with respect to said holding frame members, 37. Apparatus according to claim 35, wherein said at least one pushing roller member is carried at a bending frame separate from the holding frame members.

* * * * *